United States Patent [19]

Martin et al.

[11] Patent Number: 4,700,429

[45] Date of Patent: Oct. 20, 1987

[54] QUICK RELEASE WAND FOR CANNISTER VACUUM CLEANER

[75] Inventors: William J. Martin, Watervliet, Mich.; John M. Chun, Mound, Minn.

[73] Assignee: Whirlpool Corporation, Benton Harbor, Mich.

[21] Appl. No.: 922,395

[22] Filed: Oct. 23, 1986

[51] Int. Cl.[4] ..... A47L 9/24

[52] U.S. Cl. ..... 15/377; 15/339; 285/7; 439/192

[58] Field of Search ..... 15/339, 377; 174/47; 285/7; 339/15

[56] References Cited

U.S. PATENT DOCUMENTS

| | | | |
|---|---|---|---|
| 3,159,412 | 12/1964 | Descarries | 285/7 |
| 3,203,023 | 8/1965 | Jepson et al. | 15/339 X |
| 3,245,698 | 4/1966 | Fromknecht | 285/7 |
| 3,351,359 | 11/1967 | Ferraris | 285/7 |
| 3,553,629 | 1/1971 | Brown et al. | 258/7 X |
| 3,565,464 | 2/1971 | Wolf | 285/7 |
| 3,633,942 | 1/1972 | Meyerhoefer | 285/7 X |
| 3,962,745 | 6/1976 | Collier | 285/7 |
| 4,422,702 | 12/1983 | Nordeen | 339/15 |
| 4,423,534 | 1/1984 | Lyman et al. | 15/410 |
| 4,549,328 | 10/1985 | Martin et al. | 15/338 |

*Primary Examiner*—Chris K. Moore

*Attorney, Agent, or Firm*—Wood, Dalton, Phillips, Mason & Rowe

[57] ABSTRACT

A vacuum cleaner having a wheeled nozzle with a two-piece wand defining a lower end connected to a swivel connector portion of the nozzle. Guide structure is provided for accurately aligning cooperating male and female terminals on the wand and swivel connector of the nozzle for facilitated connection therebetween when the lower end of the wand is connected to the swivel connector for providing a suction connection from an associated cannister to the nozzle. A foot pedal-operated lever is provided for releasing a latch retaining the lower end of the wand to the swivel connector when desired. A connector connects the upper end of the lower portion of the wand to the lower end of the upper portion thereof by a rotatable connection to permit limited rotation of the upper portion of the wand about the axis of the wand for selective disposition of the handle connected to the upper end of the upper portion of the wand. The guide structure guides the latch carried by the lower end of the wand into aligned association with a latch opening in the swivel connector.

20 Claims, 6 Drawing Figures

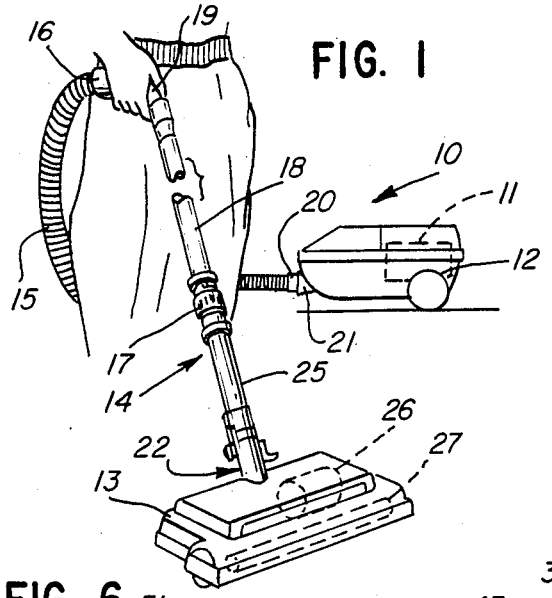
FIG. 1
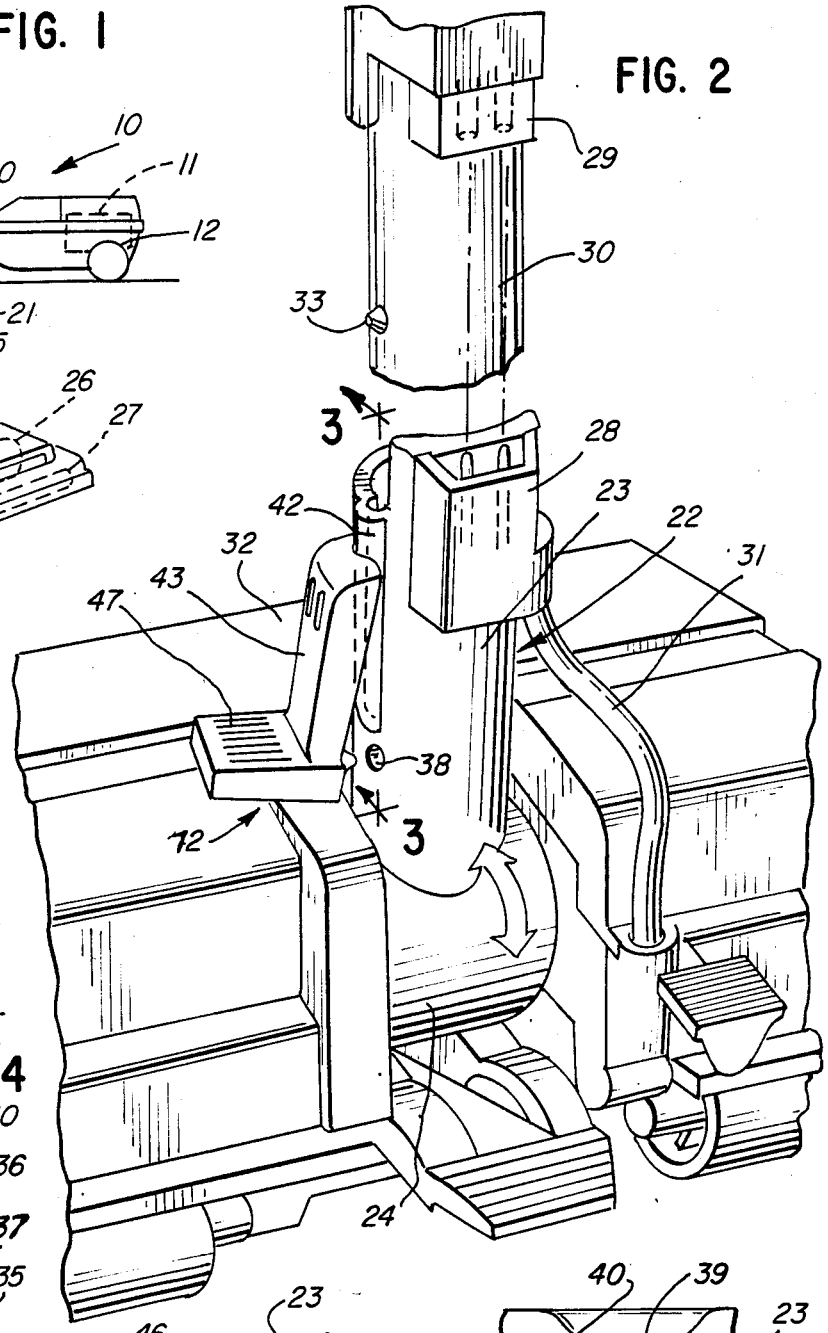
FIG. 2
FIG. 6
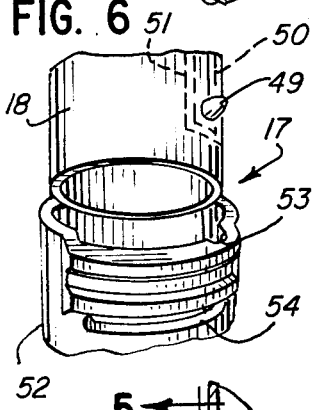
FIG. 3
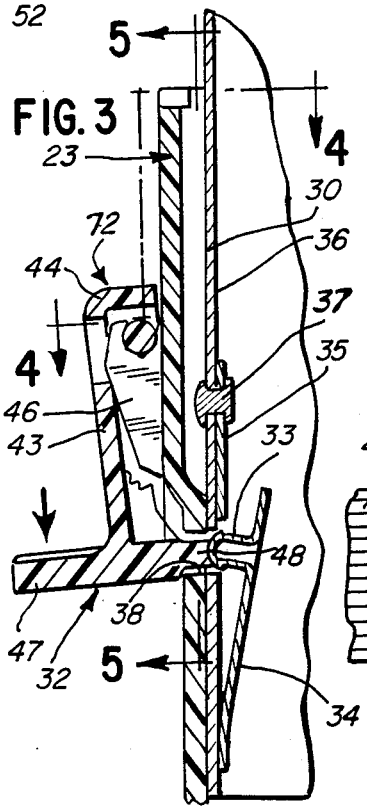
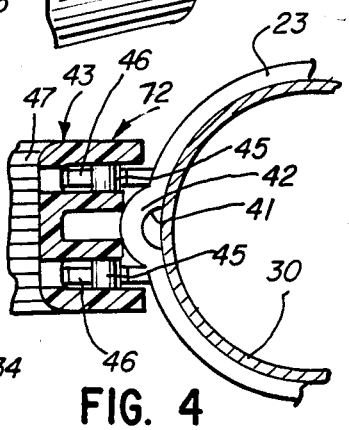
FIG. 4
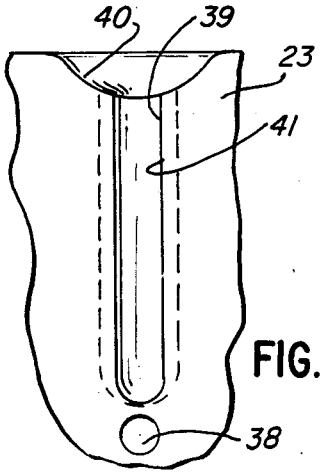
FIG. 5

QUICK RELEASE WAND FOR CANNISTER VACUUM CLEANER

BACKGROUND OF THE INVENTION

1. Field of the Invention

This invention relates to vacuum cleaners and in particular to a quick release wand for use with a canister vacuum cleaner having a wheeled nozzle.

2. Background Art

In one form of canister-type vacuum cleaner a wheeled nozzle is connected to the suction means in a canister by means of a wand connected to the nozzle and to a flexible hose connected between the wand and the canister. The upper end of the wand defines a somewhat turned handle for grasping by the user in moving the nozzle over the surface to be vacuum cleaned.

In one form of such nozzle, a rotary brush is driven by an electric motor for improved removal of dirt from the surface being cleaned. Power for the electric motor is delivered from the canister through wires embodied in the flexible hose and through a power cord associated with the wand.

It is further conventional to provide a connector on the nozzle which swivels about a horizontal axis so as to permit the wand to be brought downwardly from the upright normal position to one generally parallel with the floor so as to permit the nozzle to be moved under furniture, such as beds, chairs, etc., to clean the subjacent surface.

Because of the downturned arcuate characteristic of the handle, to permit such generally horizontal disposition of the wand, means have been provided for permitting the wand to rotate about its longitudinal axis in the swivel connector, whereby the arcuate handle may be turned to have the arcuate extent generally horizontal rather than vertical.

SUMMARY OF THE INVENTION

The present invention comprehends an improved vacuum cleaner structure having means for accurately guiding the lower end of the wand into retained association with the swivel connector.

The guiding means further accurately aligns cooperating electrical terminal means on the lower end of the wand with electrical terminal means provided on the swivel connector for effecting facilitated electrical connection therebetween as an incident of the connection of the lower end of the wand to the swivel connector.

The invention comprehends the provision of foot pedal means adapted to be operated by compression thereof by the user's foot to release the lower end of the wand for retraction from the swivel connector when desired.

The invention comprehends the provision of improved release means carried by the swivel connector for effecting the desired foot-operated release of the wand.

The lower end of the wand is effectively locked against rotation and longitudinal displacement by the retaining means.

Means are provided for connecting the upper end of the wand to the handle for permitting rotation of the handle about the longitudinal axis of the wand, when desired, such as in utilizing the wand in the lowered horizontally extending disposition with the handle turned to extend similarly horizontally.

More specifically, the invention comprehends the provision in a vacuum cleaner structure having a wheeled nozzle and a tubular wand for providing suction to the nozzle of an improved quick connect/release connection means including a tubular connector swivelly mounted to the nozzle, the connector defining a distal end, a through opening spaced from the distal end, a guide portion extending from the distal end to the opening, means on the wand for locking an end portion of the wand received in the connector releasably to the connector including a latch and means resiliently biasing the latch to project outwardly from the end of the wand, the guide portion being arranged to guide the latch into the opening in the connector as a result of insertion of the wand end portion into the connector for releasably locking the wand end portion to the connector, a release lever, and means for movably mounting the release lever to the connector, the release lever having a foot pedal portion engageable by a user's foot for urging the latch inwardly from the opening against the action of the biasing means to permit withdrawal of the wand end portion from the connector.

In the illustrated embodiment, the nozzle includes electrically powered means, such as an electrically driven brush. The structure further includes cooperating male and female electrical terminal means on the end portions of the wand and connector, the guide means further cooperating with the latch to cause the electrical connection means on said end portion of the wand to be aligned with the electrical connection means on the connector as a result of the insertion of the end portion of the wand into said connector.

Further more specifically, the invention comprehends a vacuum cleaner structure having improved means for providing suction to the nozzle including a tubular connector swivelly mounted to the nozzle, a tubular wand defining a longitudinal axis and having an upper handle portion and a lower end portion, means for releasably locking the lower end portion of the wand to the connector against longitudinal and rotational displacement, and joint means for longitudinally fixedly connecting the handle portion to the lower end portion of the wand to permit a preselected amount of rotation about said longitudinal axis.

The vacuum cleaner structure of the present invention is extremely simple and economical while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner structure embodying the invention;

FIG. 2 is a fragmentary enlarged rear perspective view thereof;

FIG. 3 is a fragmentary enlarged vertical section taken substantially along the line 3—3 of FIG. 2;

FIG. 4 is a fragmentary enlarged horizontal section taken substantially along the line 4—4 of FIG. 3;

FIG. 5 is a fragmentary vertical elevation of a portion of the swivel connector illustrating the guide means thereon in greater detail; and FIG. 6 is a fragmentary exploded perspective view of the means for connecting the upper end of the wand to the lower end of the wand.

BEST MODE FOR CARRYING OUT THE INVENTION

In the exemplary embodiment of the invention as disclosed in the drawing, a vacuum cleaner generally designated 10 is shown to include a canister having suction means generally designated 12. A wheeled nozzle 13 is connected to the canister by means of a wand 14 and a flexible hose 15 having one end 16 connected through a handle 19 to an upper end 18 of the wand, which is connected to the lower end 25 of the wand by a connector 17. The other end 20 of the hose is connected to the canister by a suitable connector 21.

The present invention is concerned with the means for connecting the hose to the wand, the means for connecting the upper end of the wand to the lower end of the wand, and the means for connecting the lower end of the wand to a swivel connector 22 on the nozzle. The swivel connector 22 includes an upper tubular portion 23 and a lower tubular swivel portion 24 extending at right angles to the upper portion 23 and rotatable about a horizontal axis on the nozzle. Suction is applied through the interior of the swivel connector to the underside of the nozzle from the wand retained in fluid flow association with the nozzle.

Concurrently with the suction connection of the wand to the swivel connector, an electrical connection is made for energizing the electric motor 26 provided for driving the brush 27 of the nozzle. More specifically, a male electrical terminal 28 is mounted to the upper end of the swivel connector portion 23 and a complementary female electrical connector 29 is mounted to the lower end 30 of the wand lower portion 25. Terminals 28 and 29 are illustrated with two mating male and female terminals. However, the present invention is also employed in three-wire systems with appropriate changes in the terminals. Terminal 29 is connected through a suitable power cord to the cuff end 16 of the hose, which may be provided with conventional integral electrical conductors embodied therein electrically connected to the electrical power supply through the canister in the normal manner. The present invention is advantageously used with either two-wire hose or three-wire hose as indicated above. As shown in FIG. 2, a suitable power cord 31 is connected from the lower electrical terminal 28 to extend through the nozzle into electrical association with the motor 26.

To assure aligned connection of terminal 29 with terminal 28 when the wand end 30 is inserted into the tubular portion 23 of the swivel connector to effect the suction connection from the canister to the nozzle, and to provide for facilitated releasable locking of the wand lower end to the swivel connector, an improved retention means generally designated 32 is provided. More specifically, as shown in FIG. 2, wand lower end portion 30 is provided with a projecting latch 33 carried on a flat spring 34 formed in a plate 35 secured to the inner surface 36 of the wand lower portion 30 by a suitable rivet 37. As shown in FIG. 2, the latch 33 and the electrical terminal 29 are disposed substantially 90° apart about the longitudinal axis of tubular end portion 30.

Spring 34 biases the projecting latch 33 outwardly through an opening 38 in the wand end portion 30 to lock the wand lower end portion 30 to the swivel connector portion 23 against rotational and longitudinal displacement from the fully inserted position thereof illustrated in FIGS. 1 and 3.

The spring-mounted latch 33 comprises a unitarily integral projection which is guided into alignment with opening 38 as a result of the wand lower portion 30 being urged into the swivel portion 23, by means of a guide groove 39 provided in the inner wall of the swivel connector portion 23, as shown in FIG. 5. The guide groove includes an arcuately tapered entrance portion 40 and a longitudinally extending rectilinear portion 41 extending downwardly from the upper end of the connector portion 23 to closely adjacent the opening 38. As seen in FIG. 2, the guide is defined by a protuberant portion 42 of the wall of swivel connector portion 23.

Thus, when the wand lower end portion 30 is inserted into the upper end of the swivel connector portion 23, with the latch received in the arcuate entrance portion 40 of the guide groove, the guide groove urges the latch into aligned association with the rectilinear portion 41 thereof, thereby automatically aligning the female terminal 29 on the wand lower portion 30, with the male terminal 28 on the swivel connector, as well as aligning the latch 33 with the opening 38 for automatic reception in the opening 38 as a result of the full insertion of the wand lower portion 30 into the swivel connector portion 23, thereby ensuring positive electrical connection between the wand and the swivel connector when the wand is fully inserted in the connector 23.

The invention further comprehends an improved means for removing the latch 33 from opening 38 when it is desired to remove the wand from the swivel connector. Thus, as best seen in FIGS. 2, 3 and 4, the release means generally designated 72 includes a lever 43 defining an upper end portion 44 having a pair of cylindrical pivots 45 snap-fitted in a corresponding pair of pivot supports 46 formed integrally with the swivel connector portion 23.

The lower end of the lever 43 defines an outwardly projecting foot pedal portion 47 adapted to be engaged by the user's foot to swing the pivot lever in a counterclockwise direction as seen in FIGS. 2 and 3, as a result of a downward urging of the pedal portion 47.

As best seen in FIG. 3, lever 43 further includes an inturned projection 48 adapted to pass into opening 38 and displace the latch 33 projecting inwardly therefrom so as to permit the wand lower end 30 to be axially withdrawn from the swivel connector portion 23 when desired.

As indicated briefly above, the wand lower portion 25 is connected to the wand upper portion 18 by a joint means comprising an improved connector 17. More specifically, as seen in FIG. 6, upper wand portion 18 is provided with a projecting latch 49 carried on a flat spring 50 formed in a metal plate 51 secured to the wand portion 18 to project resiliently outwardly therefrom. The connector 17 further includes a collar 52 secured to the upper end of the wand portion 25 adapted to snugly receive the lower end of the wand portion 18, with the projection 49 being received in a longitudinally extending groove 53 as the wand portion 18 is inserted into the collar.

When the wand portion 18 is fully inserted into the collar, the spring latch 49 is received in a segmentally annular slot 54 extending arcuately from the lower end of the groove portion 53. This permits the latch 49 to be selectively moved approximately 90° about the axis of the wand, permitting the handle 16 connected to the upper end of wand portion 18 to be turned approximately 90° relative to the normal downturned arrangement thereof illustrated in FIG. 1.

Thus, when it is desired to lower the handle to a generally horizontal disposition by swiveling thereof downwardly from the upright position of FIG. 2 about the horizontal axis of the swivel connector portion 24, rotation of the handle approximately 90° from the position of FIG. 1 causes the handle to extend generally horizontally with the horizontally extending wand 14 permitting the unit to be moved under furniture and the like for facilitated use of the vacuum cleaner in a floor cleaning operation.

Thus, in the present invention, the lower portion 25 of the wand remains fixed against rotation relative to the swivel connector portion 23, while the upper portion 18 of the wand may be selectively rotatively positioned as desired in the use of the vacuum cleaner.

In the illustrated construction, the wand portions 18 and 25 may be formed of tubular metal. The swivel connector 22 and connector 17 may be formed of molded synthetic resin. Lever 43 may be formed of molded synthetic resin. Thus, the improved connecting means of the vacuum cleaner construction are extremely simple and economical, while yet providing an improved means for connecting the wand to the nozzle in providing both suction and electrical connections therebetween.

The foregoing disclosure of specific embodiments is illustrative of the broad inventive concepts comprehended by the invention.

We claim:

1. In a vacuum cleaner having a wheeled nozzle, and a tubular wand for providing suction to the nozzle, an improved quick connect/release connection means comprising:

a tubular connector swivelly mounted to said nozzle, said connector defining a distal end, a through opening spaced from said distal end, and a guide portion extending from said distal end to said opening;

means on said wand for locking an end portion of the wand received in said connector releasably to the connector including a latch and means resiliently biasing the latch to project outwardly from said end of the wand, said guide portion being arranged to guide said latch into said opening in the connector as a result of insertion of the wand end portion into the connector for releasably locking the wand end portion to the connector;

a release lever; and means for movably mounting said release lever to said connector, said release lever having a foot pedal portion engageable by a user's foot for urging said latch inwardly from said opening against the action of the biasing means to permit withdrawal of the wand end portion from the connector.

2. The vacuum cleaner structure of claim 1 wherein said means for mounting the release lever to said connector comprises means pivotally mounting the release lever to said connector.

3. The vacuum cleaner structure of claim 1 wherein said release lever includes a projection removably receivable in said connector opening for displacing said latch inwardly from said opening as a result of inward urging thereof by movement of said foot pedal portion by a user's foot.

4. The vacuum cleaner structure of claim 1 wherein said means for mounting the release lever to said connector comprises means snap-fitting the release lever to said connector.

5. The vacuum cleaner structure of claim 1 wherein said means for mounting the release lever to said connector comprises a pair of pivot joints one each on opposite sides of said connector guide portion and a cooperating pivot on said release lever pivotally received therein.

6. The vacuum cleaner structure of claim 1 wherein said latch comprises a flat spring having a projection receivable in said connector opening when said wand end portion is received in said connector.

7. The vacuum cleaner structure of claim 1 wherein said latch comprises a flat spring having a projection receivable in said connector opening when said wand end portion is received in said connector and means for mounting said spring to an inner wall surface portion of the connector adjacent said opening.

8. The vacuum cleaner structure of claim 1 wherein said latch comprises a flat spring having a unitarily integral projection receivable in said connector opening when said wand end portion is received in said connector.

9. The vacuum cleaner structure of claim 1 wherein said guide portion of the connector includes a tapered entrance portion adapted to align the latch means accurately with said opening in the connector parallel to the axis of the tubular connector.

10. The vacuum cleaner structure of claim 1 wherein said guide portion of the connector includes an arcuately tapered entrance portion adapted to align the latch means accurately with said opening in the connector parallel to the axis of the tubular connector.

11. In a vacuum cleaner having a wheeled nozzle, a tubular wand for providing suction to the nozzle, and electrically powered means carried by the nozzle, an improved quick connect/release connection means comprising:

a tubular connector swivelly mounted to said nozzle, said connector defining a distal end, a through opening spaced from said distal end, and a guide portion extending from said distal end to said opening;

means on said wand for locking an end portion of the wand received in said connector releasably to the connector including a latch and means resiliently biasing the latch to project outwardly from said end of the wand, said guide portion being arranged to guide said latch into said opening in the connector as a result of insertion of the wand end portion into the connector for releasably locking the wand end portion to the connector;

a release lever;

means for movably mounting said release lever to said connector, said release lever having a foot pedal portion engageable by a user's foot for urging said latch inwardly from said opening against the action of the biasing means to permit withdrawal of the wand end portion from the connector; and cooperating male and female electrical terminal means on said end portion of the wand and connector, said guide means further cooperating with said latch to cause the electrical connection means on said end portion of the wand to be aligned with the electrical connection means on said connector as a result of said insertion of the end portion of the wand into said connector.

12. The vacuum cleaner structure of claim 11 wherein said latch and electrical terminal means on the end portion of the wand are disposed substantially 90° apart about the longitudinal axis of the tubular end portion.

13. The vacuum cleaner structure of claim 11 wherein said latch and electrical terminal means on the end portion of the wand are disposed substantially 90° apart about the longitudinal axis of the tubular end portion of the and said electrical terminal means on the end portion of the wand is spaced longitudinally of the latch to be electrically connected to the electrical terminal means on the connector as a result of the latch being brought to said opening of the connector.

14. The vacuum cleaner structure of claim 11 wherein said guide portion of the connector includes a tapered entrance portion adapted to cooperate with said latch to align the electrical terminal means on said end portion of the wand accurately with the terminal means on the connector as a result of insertion of the end portion of the wand into said connector.

15. In a vacuum cleaner having a wheeled nozzle, improved means for providing suction to the nozzle, comprising:

a tubular connector swivelly mounted to said nozzle;

a tubular wand defining a longitudinal axis and having an upper handle portion and a lower end portion;

means for releasably locking said lower end portion of the wand to the connector against longitudinal and rotational displacement; and joint means for longitudinally fixedly connecting said handle portion to said lower end portion of the wand to permit a preselected amount of rotation about said longitudinal axis.

16. The vacuum cleaner structure of claim 15 wherein said joint means permits 90° rotation of said handle portion about said longitudinal axis.

17. The vacuum cleaner structure of claim 15 wherein said joint means comprises a collar fixedly mounted on one of said wand portions and having a segmentally annular coaxial groove, and a projection on the other of said wand portions movably received in said groove.

18. The vacuum cleaner structure of claim 15 wherein said joint means comprises a collar fixedly mounted on one of said wand portions and having a segmentally annular coaxial groove extending at least substantially 90° about said axis, and a projection on the other of said wand portions movably received in said groove.

19. The vacuum cleaner structure of claim 15 wherein said joint means comprises a collar fixedly mounted on one of said wand portions and having a segmentally annular coaxial groove, and a radially outwardly resiliently biased projection on the other of said wand portions movably received in said groove.

20. The vacuum cleaner structure of claim 15 wherein said connector includes a distal end and a through opening spaced from said distal end, and a guide portion extending from said distal end to said opening, and said locking means includes a latch and means resiliently biasing said latch to project outwardly from said end of the wand, said guide portion being arranged to guide said latch into said opening in the connector as a result of insertion of the wand end portion into the connector for releasably locking the wand end portion to the connector, a release lever, and means for movably mounting said release lever to said connector said release lever having a foot pedal portion engageable by a user's foot for urging said latch inwardly from said opening against the action of the biasing means to permit withdrawal of the wand end portion from the connector.

* * * * *